US011040795B2

(12) United States Patent
Mader

(10) Patent No.: US 11,040,795 B2
(45) Date of Patent: Jun. 22, 2021

(54) PACKAGING MACHINE FOR PACKAGING PRODUCTS IN PLASTIC PACKAGING

(71) Applicant: Multivac Sepp Haggenmüller SE & Co. KG, Wolfertschwenden (DE)

(72) Inventor: Andreas Mader, Dietmannsried (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 144 days.

(21) Appl. No.: 16/394,105

(22) Filed: Apr. 25, 2019

(65) Prior Publication Data

US 2019/0329923 A1 Oct. 31, 2019

(30) Foreign Application Priority Data

Apr. 27, 2018 (DE) ..... 10 2018 110 227.5

(51) Int. Cl.
*B65B 55/10* (2006.01)
*B65B 31/04* (2006.01)

(52) U.S. Cl.
CPC ..... *B65B 55/10* (2013.01); *B65B 31/04* (2013.01)

(58) Field of Classification Search
CPC ..... B65B 55/10; B65B 31/02; B65B 31/028; B65B 31/04
USPC ..... 53/405; 422/28
See application file for complete search history.

(56) References Cited

U.S. PATENT DOCUMENTS 3,481,100 A * 12/1969 Bergstrom ..... B65B 31/021 53/433
3,899,862 A * 8/1975 Muys ..... B65B 55/10 53/426
3,992,850 A * 11/1976 Vetter ..... B65B 31/021 53/510

(Continued)

FOREIGN PATENT DOCUMENTS

CN 102711491 A 10/2012
CN 104159824 A 11/2014

(Continued)

OTHER PUBLICATIONS

Chinse Office Action Application No. 201910344313.1 dated Nov. 11, 2020, English Machine Translation—First Office Action.

(Continued)

*Primary Examiner* — Dariush Seif
(74) *Attorney, Agent, or Firm* — Brooks Kushman P.C.

(57) ABSTRACT

Packaging machine for packaging products in plastic packaging having at least one sealing station for receiving a plastic packaging to be sealed in a reception region within the sealing station. The packaging machine includes a supply line capable to supply a gas to the reception region, a discharge line capable to discharge a gas from the reception region. A valve may be disposed in the discharge line. Further, a vacuum pump may be connected to the discharge line to pump gas out of the reception region through the discharge line valve. A measuring line may be connected to the reception region at a connection point and may be connected to the discharge line in a region between the valve and the vacuum pump via a connecting line. A first shut-off valve may disposed in the connecting line and a second shut-off valve may be disposed in the measuring line.

15 Claims, 1 Drawing Sheet

(56) References Cited

U.S. PATENT DOCUMENTS 4,349,508 A * 9/1982 Liede ..... B65B 55/10 422/1
4,982,555 A * 1/1991 Ingemann ..... B65B 31/028 53/405
5,031,673 A * 7/1991 Clusserath ..... B67C 3/2642 141/6
5,271,207 A * 12/1993 Epstein ..... B65B 31/043 53/403
5,822,951 A * 10/1998 Rosik ..... B65B 57/18 53/432
6,912,828 B1 * 7/2005 Yamay ..... B29C 66/8322 53/432
7,803,316 B2 * 9/2010 Lin ..... A61L 2/208 422/28
8,366,995 B2 * 2/2013 McLaren ..... A61L 2/24 422/3
8,663,080 B2 * 3/2014 Bartoli ..... B65B 55/103 493/52
9,526,260 B2 12/2016 Bell
9,555,910 B2 * 1/2017 Vaccari ..... B29C 65/7451
9,902,509 B2 * 2/2018 Schiavina ..... B29C 65/7451
9,994,342 B2 6/2018 Furuse et al.
10,065,752 B2 9/2018 Steffens
10,150,584 B2 * 12/2018 Schiavina ..... B29C 66/849
10,913,562 B2 * 2/2021 Gabler ..... B65B 31/04
2003/0046907 A1 * 3/2003 Costello ..... G01M 3/3281 53/512
2003/0196412 A1 * 10/2003 Foulke, Jr. ..... B65B 31/028 53/432
2004/0101438 A1 * 5/2004 Nelson ..... B65B 55/10 422/31
2004/0228759 A1 * 11/2004 Frost ..... B65B 55/10 422/28
2008/0019864 A1 * 1/2008 Savage ..... A61L 2/07 422/27
2013/0019900 A1 * 1/2013 Ehrmann ..... F04C 25/02 134/18
2014/0260086 A1 * 9/2014 Schiavina ..... B29C 66/849 53/97
2015/0210413 A1 * 7/2015 Schiavina ..... B29C 66/83221 53/86
2016/0001488 A1 * 1/2016 Clusserath ..... B23K 1/0016 264/525
2016/0068293 A1 * 3/2016 Cutting ..... A61J 1/10 53/432
2016/0355282 A1 * 12/2016 Valli ..... B65B 7/164
2018/0155074 A1 * 6/2018 Gabler ..... B65B 11/52
2018/0222619 A1 * 8/2018 Ehrmann ..... B29C 66/131
2018/0346167 A1 * 12/2018 Capriotti ..... B65B 47/10
2019/0031379 A1 * 1/2019 Palumbo ..... B65B 31/028
2019/0055040 A1 * 2/2019 Capitani ..... B65B 41/04
2019/0329923 A1 * 10/2019 Mader ..... B65B 31/028
2019/0382147 A1 * 12/2019 Radler ..... B65B 9/02
2020/0114031 A1 * 4/2020 Soellner-Wein ..... B65B 55/10

FOREIGN PATENT DOCUMENTS

CN 104169174 A 11/2014
DE 102009022545 B3 12/2010
EP 1595794 A1 11/2005
JP 2015-9877 A 1/2015

OTHER PUBLICATIONS

CN 102711491 A, U.S. Pat. No. 9,526,260 B2.
CN 104159824 A, U.S. Pat. No. 10,065,752 B2.
CN 104169174 A, U.S. Pat. No. 9,994,342 B2.
JP 2015-9877A, Abstract & Machine Translation.
Chinese First Office Action dated Nov. 11, 2021 (with English Machine Translation), Application No. 201910344313.1, 12 Pages.

* cited by examiner

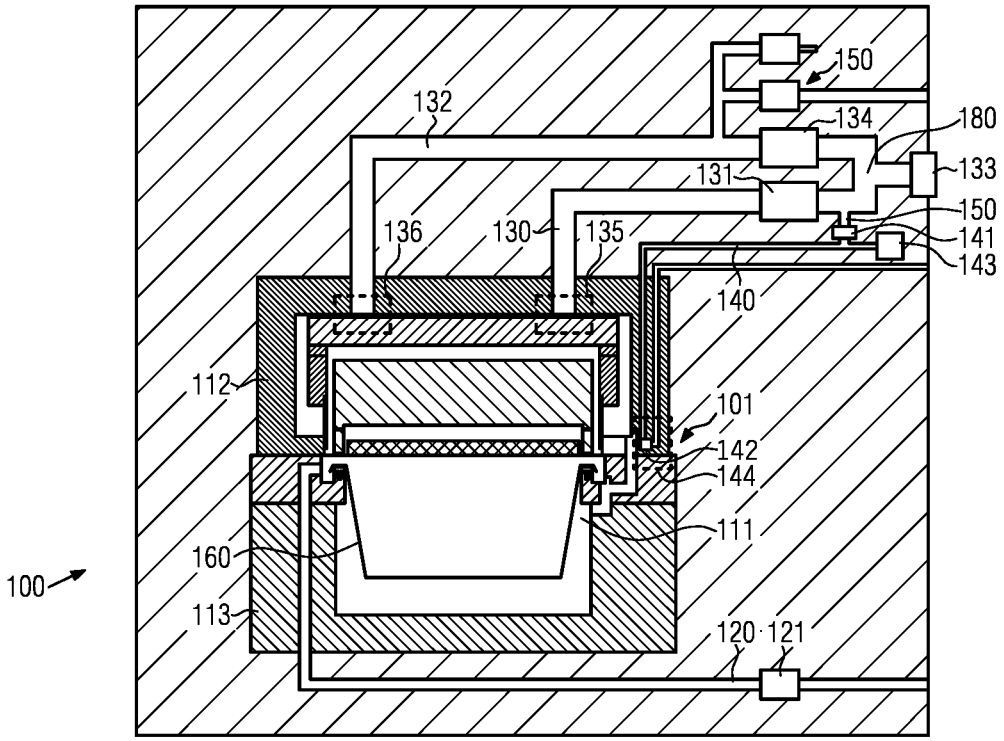
150
132
134
180
133
131
150
136
130
135
141
143
140
112
101
142
144
111
160
100
113
120
121

PACKAGING MACHINE FOR PACKAGING PRODUCTS IN PLASTIC PACKAGING

CROSS-REFERENCE TO RELATED APPLICATIONS

This application claims priority to German Patent Application No. 10 2018 110 227.5 filed on Apr. 27, 2018 to Andreas Mader, currently pending, the entire disclosure of which is incorporated herein by reference.

FIELD OF THE INVENTION

The present invention relates to packaging machines for packaging products in plastic packaging as well as to methods for measuring the presence of a gas in a sealing station of a packaging machine for receiving a plastic packaging to be sealed therein.

BACKGROUND OF THE INVENTION

Packaging machines for packaging products into plastic packaging are well known. For instance, machines are known with which foods, such as sausages or sliced cheese, can be introduced into (thermoformed) plastic packaging and the packaging can then be sealed with the food inserted therein. Other applications, for example, in the field of pharmaceutical technology, are known for such machines.

Packaging machines typically comprise sealing stations that comprise a single-part or multi-part sealing tool into which the plastic packaging is introduced (with the product introduced therein) and then sealed with a film. In order to prevent unwanted gases, in particular oxygen, from remaining in the packaging after it has been sealed, it is known to expose the reception region in the sealing station to gas (gas flushing). This gas is typically sterilizing gas or at least gas which prevents the proliferation of bacteria, such as nitrogen. This gas is basically harmless when used in the food industry, and can contribute to the preservation. Alternatively, it is known to evacuate the reception region while the plastic packaging is sealed so that no gaseous residues remain in the reception region to the extent possible.

Difficulties can be encountered in determining when exactly the gas flushing process or the evacuation process of the reception region is completed. The sensors already used for this, which are arranged in measuring lines that are connected to the reception region, indeed provide an indication of how much oxygen still remains in the reception region. The devices and methods currently used, however, are inaccurate so that it is only to a limited degree possible to determine the ideal time to terminate the evacuation process or the gas flush. This entails an increased discard rate for products that have not been adequately gas flushed or evacuated. Thus, there is a need in the art for an improved packaging machine and sealing station which can more accurately provide packagings that have been adequately evacuated and/or flushed with a desired gas.

SUMMARY OF THE INVENTION

Starting from known prior art, the technical object to be satisfied is to provide a packaging machine and a method for measuring the presence of a gas in a sealing station of a packaging machine for receiving a plastic packaging to be sealed, which ensures the accurate determination of the residual amount of unwanted gases in the reception region and therefore the most accurate possible adjustment of the duration of the gas flush or evacuation.

The packaging machine according to the invention for packaging products in plastic packaging according to a first embodiment may include at least one sealing station for receiving a plastic packaging to be sealed. The sealing station may have a reception region within the sealing station in which a plastic packaging can be received. A supply line with which a gas can be supplied to the reception region and a discharge line with which a gas can be discharged from the reception region, and a valve may be disposed in the discharge line.

A vacuum pump which may be connected to the discharge line and can pump gas out of the reception region via the valve of the discharge line, and a measuring line that may be connected to the reception region at a connection point and at the end facing away from the reception region comprises a measuring device with which a gas can be detected. The measuring line may be connected to the discharge line in a region between the valve and the vacuum pump via a connecting line and a first shut-off valve may be disposed in the connecting line, wherein the measuring line may comprise a second shut-off valve in the region of the connection point.

The "connection point" is presently to be understood as the point at which the measuring line and the reception region meet and where there is a passage from the reception region to the measuring line. The region of the connection point, in which the second shut-off valve is arranged, may generally comprise any locations in the measuring line, the connection point itself also being comprised. However, this only means in this embodiment, the locations in the measuring line that may be arranged in the flow direction of a gas from the reception region through the measuring line to the vacuum pump upstream of the connecting line, so that a part of the measuring line and the measuring device may be isolated from the remainder of the measuring line and, in particular, from the reception region and the vacuum pump when the first shut-off valve and the second shut-off valve are shut off. However, it is not necessary according to the invention for the entire length of the measuring line to be isolated from the reception region and the vacuum pump when the first and the second shut-off valves are shut off.

This embodiment of the packaging machine according to the invention allows the selective evacuation of the measuring line and, therefore, more reliable measurement of the gas mixture that is actually still contained in the reception region once the reception region has been evacuated. Any remaining amount of gas from a last cycle for packaging a plastic packaging can in fact be effectively removed from the measuring line in this embodiment. As such, the measuring line can be isolated during the gas flushing process and while the sealing tool is open for introducing a packaging into the reception region, so that no undesired gas mixture collects in the measuring line, which could falsify the measurement result.

In another embodiment, the packaging machine according to the invention may comprise at least one sealing station for receiving a plastic packaging to be sealed, where the sealing station may comprise a reception region within the sealing station in which a plastic packaging can be received. The packaging machine may further include a supply line with which a gas can be supplied to the reception region, and a discharge line with which a gas can be discharged from the reception region, where a valve is disposed in the discharge line. In addition, a measuring line that is connected to the reception region at a connection point and at the end facing away from the reception region may comprise a measuring device with which a gas can be detected. Further, the measuring line may be connected to the discharge line in a region downstream of the valve and a first shut-off valve is disposed in the connecting line, where the measuring line comprises a second shut-off valve in the region of the connection point.

The definitions regarding the connection point and the region of the connection point as described with reference to the first embodiment also apply in this embodiment. The advantage in this embodiment lies in the fact that selective gas flushing and isolating the measuring line can occur when the sealing station is opened and when the other components of the sealing station are gas flushed, although no vacuum pump is used. This embodiment may also ensure that the measured value of gas remaining in the reception region is measured as reliably as possible.

The first embodiment and the second embodiment are to be understood as alternatives to one another, but allow the above formulated object to be equally satisfied for different implementations of the packaging machine.

In one embodiment, the measuring device may be or may comprise a measuring device for measuring molecular oxygen. Since oxygen is one of the most relevant gases when it comes to the possible contamination of products, one of the most important sources of contamination of products in plastic packaging can be eliminate with this embodiment, which improves the shelf life.

Furthermore, it may be provided that the discharge line comprises at least two separate lines which are each connected to the reception region at different connection points and where a valve is arranged in each line. The connection points preferably differ from the connection point of the measuring line to the reception region, but may also at least partially coincide. This embodiment advantageously enables the evacuation or continuous gas flushing of different regions of the reception region of the sealing station, so that the gas flushing/evacuation occurs in the reception region as completely as possible.

In one further development of this embodiment, it may be provided that the lines coincide at a connection point downstream of the valves and form a common line, where the measuring line is connected to the common line via the connecting line. If a vacuum pump connects to the common line, then the complexity of the packaging machine can be reduced. If no vacuum pump is provided, then the common line can be open, for example, to the environment.

Furthermore, it can be provided that a second valve may be disposed in the supply line. This valve may be used to selectively open or close the supply line for the gas used for gas flushing. Accordingly, the "dead volume" of the gas for flushing, which remains in the supply line after the end of the gas flushing process, can be reduced. Distortion of the result of the value measured by the measuring device can thus be avoided.

It can also be provided that the sealing station may be configured as a two-part sealing tool with an upper tool and a lower tool and that the upper tool and the lower tool in the closed state surround the reception region. This is a structurally preferred embodiment.

A method according to the invention for measuring the presence of a gas in a sealing station of a packaging machine for receiving a plastic packaging to be sealed comprises the steps described below. This method may be performed in devices wherein the sealing station comprises a reception region within the sealing station in which a plastic packaging can be received. This method may be implemented when the packaging machine further comprises a supply line with which a gas can be supplied to the reception region, a discharge line with which a gas can be discharged from the reception region, where a valve is disposed in the discharge line, a vacuum pump which is connected to the discharge line and can pump gas out of the reception region via the valve of the discharge line, a measuring line which is connected to the reception region at a connection point and at the end facing away from the reception region comprises a measuring device with which a gas can be detected, wherein the measuring line is connected to the discharge line in a region between the valve and the vacuum pump via a connecting line and a first shut-off valve is disposed in the connecting line, where the measuring line comprises a second shut-off valve in the region of the connection point.

The steps of the method may include one or more of the following: introducing a plastic packaging to be sealed into the reception region, while the valve and the first and the second shut-off valve are closed; opening the valve in the discharge line; evacuating the reception region via the discharge line using the vacuum pump; closing the valve in the discharge line; gas-flushing the reception region through the supply line; opening the second shut-off valve; measuring the gas in the measuring line using the measuring device; closing the second shut-off valve; and opening the first shut-off valve and evacuating the measuring line using the vacuum pump.

This embodiment may ensure that the measuring line is isolated as completely as possible while the reception region is flushed with gas or opened. Any distortion of the gas measured in the measuring process using the measuring device can be avoided as much as possible. This feature may increase the accuracy of the measured result and can be advantageously used to minimize discard.

One embodiment that the method may further comprise the step of processing the value measured by the measuring device after the measuring the gas in the measuring line step. Depending on the value measured, that the second shut-off valve is closed and the following are performed thereafter: opening the valve in the discharge line; evacuating the reception region via the discharge line using the vacuum pump; closing the valve in the discharge line; gas-flushing the reception region through the supply line; opening the second shut-off valve; measuring the gas in the measuring line using the measuring device. This embodiment is particularly advantageous because repeated evacuation of the reception region takes place in which unintentionally remaining gas can be removed from the reception region. Discard of packages out of specification can thereby be advantageously minimized.

Furthermore, it can be provided that the method further comprises step of opening a second valve in the supply line at various times and in relation to other steps and the step of closing the second valve in the supply line at various times and in relation to other steps. The exact end of the gas flushing process is then defined and gas possibly being unintentionally introduced via the supply lines into the reception region and therefore into the measuring line can be prevented.

Another embodiment of the method for measuring the presence of a gas in a sealing station of a packaging machine for receiving a plastic packaging to be sealed, where the sealing station comprises a reception region within the sealing station in which a plastic packaging can be received, where the packaging machine further comprises: a supply line with which a gas can be supplied to the reception region; a discharge line with which a gas can be discharged from the reception region, where a valve is disposed in the discharge line; a measuring line which is connected to the reception region at a connection point and at the end facing away from the reception region comprises a measuring device with which a gas can be detected; where the measuring line is connected to the discharge line in a region between the valve and the vacuum pump via a connecting line and a first shut-off valve is disposed in the connecting line, where the measuring line comprises a second shut-off valve in the region of the connection point.

The other embodiment of the method may comprise the steps of: (a) introducing a plastic packaging to be sealed into the reception region, while the valve and the first and the second shut-off valve are closed; (b) opening the valve in the discharge line; (c) gas-flushing the reception region via the supply line; (d) opening the first and the second shut-off valve; (e) measuring the gas in the measuring line using the measuring device; and (f) closing the first and the second shut-off valve.

It is understood that step c) is preferably terminated before the first and the second shut-off valve are opened, since otherwise the measuring line would be flooded with the flushing gas, which can distort the measurement. With this method, it may also be possible to achieve the most accurate possible measurement of the gas remaining in the reception region for embodiments of packaging machines without a vacuum pump.

In one embodiment of this method, it is provided that the pressure within the discharge line remains substantially constant during step (c). This can be realized either by arranging a pump downstream of the reception region at the end of the discharge line, the throughput of which corresponds to the supply via the supply line, or in that the discharge line is open to the atmosphere in a different way. Any overpressure, which would be detrimental to the valves, can thus be avoided.

Furthermore, it can be provided that the method further comprises the steps of: opening a second valve in the supply line after step (b); opening a second valve in the supply line prior to step (c), as well as closing the second valve in the supply line after step (c) and prior to step (d). As already described with regard to the first embodiment of the method, the dead volume of flushing gas in the supply line can then be reduced, whereby distortion of the result when measuring using the measuring device can be avoided.

The methods according to the invention can further comprise that the plastic packaging may be rejected or further processed depending on the values measured by the measuring device. For example, if it is determined that the amount of remaining gas cannot be lowered below a certain threshold value, then the packaging can be rejected so as not to convey any product that is possibly already spoiled.

Furthermore, it can be provided that the methods comprise the step of sealing the plastic packaging in the reception region that may be performed after measuring the gas in the measuring line using the measuring device or after closing the first and the second shut-off valve. Sealing the packaging can then proceed under controlled conditions and the amount of gas measured by the measuring device is now also likely to be disposed within the packaging now sealed. Other aspects and advantages of the present invention will be apparent from the following detailed description of the preferred embodiments and the accompanying drawing FIGURES.

DESCRIPTION OF THE SEVERAL VIEWS OF THE DRAWINGS

In the following, an advantageous embodiment of the present invention will be explained in more detail making reference to a drawing, in which the individual FIGURES show:

FIG. 1 is a schematic side view of one embodiment of the packaging machine in accordance with the teachings of the present disclosure.

DETAILED DESCRIPTION OF THE INVENTION

The invention will now be described with reference to the drawing FIGURES, in which like reference numerals refer to like parts throughout. For purposes of clarity in illustrating the characteristics of the present invention, proportional relationships of the elements have not necessarily been maintained in the drawing FIGURES.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows part of a packaging machine 100 comprising at least one sealing station 101. The sealing station is typically configured such that it comprises a reception region 111 into which a packaging 160 can be introduced with a product typically disposed therein and closed by way of a suitable sealing tool. For this purpose, sealing station 101 can be formed in two parts, which is typically realized in the form of an upper tool 112 and a lower tool 113, where upper tool 112 and lower tool 113 in the closed state together surround reception region 111. The lower tool can there essentially have a cavity or other depression for receiving packaging 160, whereas the actual sealing tool with the sealing plate and an optionally necessary heating element are arranged in upper tool 112.

According to the invention, reception region 111 is connected to a supply line 120. When sealing station 101 is separated into an upper tool 112 and a lower tool 113, this supply line can preferably be connected to lower tool 113. However, a connection to the upper tool is also conceivable. If lower tool 113 is configured to be immovable and only upper tool 112 is moved relative thereto, then the connection of the supply line to lower tool 113 is preferred.

Furthermore, the reception region is connected to at least one discharge line 130 at a connection point 135. Discharge line 130 in turn is connected to a vacuum pump 133 according to one embodiment and according to one alternative embodiment of the invention is open, for example, to the atmosphere. Discharge line 130 further comprises a first valve 131. It can be actuated, opened and closed, for example, by way of a control unit associated with the packaging machine.

In addition to first discharge line 130 described, further discharge lines can be provided and connected to the reception region at different connection points 136. For example, a further discharge line 132 can also be connected to upper tool 112. Alternatively or additionally, further discharge lines, presently not shown, can be provided and can also be connected, for example, to lower tool 113.

According to the invention, all these discharge lines in any case comprise corresponding valves 134.

In addition to continuing line 180, additional branch-offs 150 from the individual discharge lines can be provided upstream of valves 131 and 134 in order supply, for example, the gas used in gas flushing to a recycling process or the like.

Furthermore, it is provided according to the invention that reception region 111 is connected to a measuring line 140 at a connection point 144. Measuring line 140 in turn comprises a measuring device 143 at the end opposite connection point 144 for measuring the presence and preferably also the amount of gas in the gas mixture conveyed through measuring line 140. For example, measuring device 143 can be a measuring device that is adapted to measure the presence and/or concentration of (molecular) oxygen in a gas mixture. In this case, the measuring device can work chemically or preferably optically and ensure the most accurate possible detection of gases.

Whereas the measuring line can assume any dimensions as compared to the supply line and/or the discharge lines, it is particularly preferred to have the measuring line have the smallest possible diameter, preferably less than 50% of the diameter of discharge line 130, more preferably less than 5 mm. Connecting line 150, however, can be sized such that the fastest possible discharge of the gases from the measuring line is possible. The connecting line therefore preferably has at least the same diameter as the measuring line or a larger diameter.

Measuring line 140 is further connected via a connecting line 150 to a region of discharge line 130 downstream of valve 131 in the flow direction of a gas from feed line 120 to vacuum pump (optionally shown here) 133 (or to the atmosphere in embodiments without a vacuum pump). A first shut-off valve 141 is disposed in connecting line 150. In addition, the measuring line is connected with a second shut-off valve 142 to reception region 111 in a region around connection point 144. In this case, second shut-off valve 142 need not be located exactly at connection point 144, but can also be located downstream within measuring line 140. In any case, however, it is arranged in the measuring line such that a region of measuring line 140 together with measuring device 143 and a part of connecting line 150 is isolated from remaining reception region 111 and discharge line 131, or line 180, respectively, when shut-off valves 141 and 142 are closed.

A second valve 121 can further be arranged in supply line 120 and allow the supply line to be closed. Part of the supply line and reception region 111 can then be isolated from the further inflow of the flushing gas.

Depending on whether a vacuum pump 133 is arranged at the end of discharge line 130 or (common) discharge line 180, respectively, or this line is open to the atmosphere, two embodiments according to the invention arise for the methods for measuring the gases remaining in the measuring line or selectively in reception region 111.

The method described hereafter is performed in the presence of a vacuum pump. In a first step a), a plastic packaging 160 to be closed is introduced into reception region 111 while valves 131, 134 in discharge lines 130, 132 as well as first and second shut-off valve 141, 142 in measuring line 140 or the connecting line, respectively, are closed. This can be done, for example, by moving upper or lower sealing tool 112, 113, or both, in the case of a two-part embodiment of the sealing station, in order to open a region through which the packaging can enter the reception region.

In a next step b), valve 131 in discharge line 130 or the valves in the corresponding discharge lines, respectively, are opened and the reception region is evacuated using vacuum pump via the discharge lines with open valves 131 and 134 in a step c). For this purpose, vacuum pump 133 is switched on. If a desired pressure, for example 0.01 hPa, has been reached, the vacuum pump is switched off again. A different event can be also used to regulate the shutdown of the vacuum pump, such as the lapse of a certain amount of time.

In next step d), valve 131 in discharge line 130 (or all valves in all compartments [sic]) is closed. This is followed by gassing of reception region 111 via feed line 120 in step e). If a second valve 121 is provided in the supply line, then step e) first comprises opening this valve 121 and then closing this valve after the gas flush has been completed. Opening the second valve can be understood as being step m), closing second valve 121 as step n).

After gas flushing, second shut-off valve 142 is then opened in step f), so that the gas can flow from the reception region into measuring line 140. Then, in step g), the gas within the measuring line is measured using the measuring device, to the extent that it has reached the measuring device. The composition of the entire gas mixture or only selectively certain gases can there be measured. For example, the measuring device can be configured as an optical measuring device and in step g) measure molecular oxygen. Measuring is preferably also done in a quantity-sensitive manner, so that after completion of step g), it is also known what proportion of the measured gas is disposed in the gas mixture or what the absolute amount of the gas in reception region 111 is.

In step h) following step g), second shut-off valve 142 is closed and first shut-off valve 141 is opened. By switching on the vacuum pump, the measuring line is then evacuated using vacuum pump 133 (while valves 131, 134 are closed) before also the first shut-off valve in connecting line 150 is closed and the process can start again with step a).

Between step h) and the renewed performance of step a), it can be provided that the packaging in the sealing station is now finally sealed and removed from the sealing station before a further plastic packaging 160 is introduced into the sealing station.

In one embodiment, it can further be provided that, following step g); it is first determined whether a specific value of the concentration of a gas in the measuring line has been reached. For example, it can be provided that a maximum value of the oxygen remaining in the reception region (quantity or concentration) is predetermined and it is determined from the value measured by the measuring device whether this maximum value has been undershot or exceeded. This can be easily achieved by subtracting the value measured from the threshold value. If it is determined that the value measured is above the maximum value, then steps b) to g) can be carried out again, where the measuring line is first evacuated again before step b) is carried out, for example in that the second shut-off valve is closed and the first shut-off valve is opened. Due to the renewed evacuation and gas flushing cycle of the reception region, the amount of, for example, oxygen still contained can be reduced.

If no vacuum pump is provided in or at the end of discharge line 130, then a method alternative to the one described above is carried out.

Similar to the method previously described, it first comprises that in a step a) a plastic packaging 160 to be closed, which is introduced into reception region 111, while valve 130, 134 and first and second shut-off valve 141, 142 are closed [sic].

Subsequently, in step b), valve 131, 134 in discharge line 130, 131 is opened and reception region 111 is gas-flushed via supply line 120 in subsequent step c). Here as well, it can again be provided that a second valve 121 is first opened prior to step c) in supply line 120 and closed after completion of the gas flushing.

However, unlike the first embodiment with the presence of a vacuum pump, the valve is not necessarily closed after step c). A step d) now follows in which the first and the second shut-off valve are opened and the reception region is possibly further gas-flushed so that a gas flow containing a gas mixture of the gas used for gas flushing (for example nitrogen) and the gas mixture originating from the reception region arises through the discharge line and also the first and the second shut-off valve.

Gas flushing can be terminated before next step e) which comprises measuring the gas in the measuring line using the measuring device in order to reduce a gas flow through the measuring line as much as possible. Since measuring the gas in the measuring line ultimately entails a temporal integration of individual measuring points, distortion by the additional entry of gas can thus be avoided.

The first and the second shut-off valve are subsequently closed in step f). Similar to the embodiment with the presence of a vacuum pump, the sealing station 101 can now be opened between step f) and the renewed performance of step a) in order to remove packaging 160 after sealing and insert a new packaging according to step a).

It can be provided that the discharge lines are open to the atmosphere and the pressure within the discharge line (and therefore also in the measuring line) therefore remains substantially constant during gas flushing. This ensures that reliably measuring the partial pressures of certain gases using a suitable measuring device is possible, so that determining the gas to be measured, for example oxygen, can be done reliably.

Similar to the procedure in the presence of a vacuum pump, step c) can comprise that a second valve 121 is opened in the supply line before the actual gas flushing and is closed after gas flushing, which need not necessary already be after step c), but can also be only after step d).

Both embodiments described have in common that further processing of the plastic packaging can be effected in dependence on the measured value of the measuring device. As already described, gas flushing and evacuation can be carried out again in the presence of the vacuum pump, for example, if a certain threshold value for the quantity or concentration of the remaining gas in the reception region is exceeded. However, it is also conceivable that, instead of again gas flushing and possibly evacuating, the plastic packaging is not sealed at all when the threshold value is exceeded, but is rejected. Other methods, such as separately labeling a respective packaging, are also conceivable.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine for packaging products in plastic packaging, the packaging machine comprising:

a sealing station for receiving a plastic packaging to be sealed, said sealing station comprising a reception region within said sealing station in which the plastic packaging is received;

a supply line capable of supplying a first gas to said reception region;

a discharge line capable of discharging a second gas from said reception region, said discharge line including a valve disposed therein;

a vacuum pump operably connected to said discharge line and capable of pumping said second gas out of said reception region through said valve of said discharge line;

a measuring line in fluid connection with said reception region at a connection point, the measuring line including a measuring device for detecting one or more components of the second gas at an end of the measuring line disposed away from said reception region;

wherein said measuring line is in fluid communication with said discharge line at a location between said valve and said vacuum pump by a connecting line, a first shut-off valve is disposed in said connecting line, and wherein said measuring line comprises a second shut-off valve proximate said connection point.

2. The packaging machine according to claim 1, wherein said measuring device includes a measuring device for measuring the one or more components comprising molecular oxygen.

3. The packaging machine according to claim 1, wherein said discharge line comprises at least a first discharge line and a second discharge line, wherein each of the first discharge line and the second discharge line are connected to said reception region at different connection points and where a first valve is disposed in the first discharge line and a second valve is disposed in the second discharge line.

4. The packaging machine according to claim 3, wherein the first discharge line and the second discharge line coincide at a second connection point downstream of said first and said second valves to form a common line, where said measuring line is connected to said common line by said connecting line.

5. The packaging machine according to claim 1, further comprising a second valve disposed in said supply line.

6. The packaging machine according to claim 1, wherein said sealing station is configured as a two-part sealing tool with an upper tool and a lower tool and wherein said upper tool and said lower tool surround said reception region when said upper tool and said lower tool are disposed in a closed state.

7. A method for measuring presence of a gas in a sealing station of a packaging machine for packaging products in plastic packaging, wherein the sealing station includes a reception region, and the packaging machine further includes a supply line for supplying a first gas to the reception region, a discharge line for discharging a second gas from the reception region, a valve disposed in the discharge line, a vacuum pump operably connected to the discharge line and configured to pump the second gas out of the reception region through the valve in the discharge line, and a measuring line in fluid connection with the reception region at a connection point and including a measuring device, the method comprising the steps of:

(a) introducing a plastic packaging to be sealed into the reception region while the valve is closed, and while a first shut-off valve and a second shut-off valve are closed, wherein the measuring line is in fluid communication with the discharge line at a location between the valve and the vacuum pump by a connecting line, the first shut-off valve is disposed in the connecting line, and the second shut-off valve is disposed in the measuring line proximate the connection point;

(b) opening the valve in the discharge line;

(c) evacuating the reception region via the discharge line using the vacuum pump;

(d) closing the valve in the discharge line;

(e) gas-flushing the reception region via the supply line;

(f) opening the second shut-off valve;

(g) measuring, using the measuring device, a value of one or more components in the second gas in the measuring line at an end of the measuring line disposed away from the reception region; and (h) closing the second shut-off valve and opening the first shut-off valve and evacuating the measuring line using the vacuum pump.

8. The method according to claim 7, further comprising the step of processing the value of the one or more components of the second gas measured by the measuring device after step g), and, depending on the value of the one or more components compared to a predetermined value of the one or more components, closing the second shut-off valve and then performing steps (b), (c), (d), (e), (f) and (g) thereafter.

9. The method according to claim 7, further comprising the steps of opening a second valve in the supply line after step (d) and prior to step (e), as well as closing the second valve in the supply line after step (e) and prior to step (f).

10. The method according to claim 7, further comprising the step of rejecting or further processing the plastic packaging depending on the value of the one or more components in the second gas measured by the measuring device.

11. The method according to claim 7, further comprising the step of sealing the plastic packaging in the reception region after one of: the step of measuring a value of the one or more components in the second gas in the measuring line using the measuring device or the step of closing the first shut-off valve and the second shut-off valve.

12. A method for measuring presence of a gas in a sealing station of a packaging machine for packaging products in plastic packaging, wherein the sealing station includes a reception region, and the packaging machine further includes a supply line for supplying a first gas to the reception region, a discharge line for discharging a second gas from the reception region, a valve disposed in the discharge line, a vacuum pump operably connected to the discharge line and configured to pump the second gas out of the reception region through the valve in the discharge line, and a measuring line in fluid connection with the reception region at a connection point and including a measuring device for detecting one or more components of the second gas at an end of the measuring line disposed away from the reception region, the method comprising:

(a) introducing a plastic packaging to be sealed into the reception region while the valve is closed, and while a first shut-off valve and a second shut-off valve are closed, wherein the measuring line is in fluid communication with the discharge line at a location between the valve and the vacuum pump by a connecting line, the first shut-off valve is disposed in the connecting line, and the second shut-off valve is disposed in the measuring line proximate the connection point;

(b) opening the valve in the discharge line;

(c) gas-flushing the reception region using the supply line;

(d) opening the first shut-off valve and the second shut-off valve;

(e) measuring the second gas in the measuring line using the measuring device; and (f) closing the first shut-off valve and the second shut-off valve.

13. The method according to claim 12, where pressure within the discharge line remains substantially constant during step (c).

14. The method according to claim 12, further comprising the step of opening a second valve in the supply line after step (b) and prior to step (c), as well as closing the second valve in the supply line after step (c) and prior to step (d).

15. A packaging machine for packaging products in plastic packaging, the packaging machine comprising:

a sealing station for receiving a plastic packaging to be sealed, said sealing station comprising a reception region within said sealing station in which the plastic packaging is received;

a supply line capable of supplying a first gas to said reception region;

a discharge line capable of discharging a second gas from said reception region, said discharge line including a valve disposed therein;

a vacuum pump operably connected to said discharge line and capable of pumping said second gas out of said reception region through said valve of said discharge line;

a measuring line in fluid connection with said reception region at a connection point, the measuring line including a measuring device for detecting one or more components of a reception region gas at an end of the measuring line disposed away from said reception region;

wherein said measuring line is in fluid communication with said discharge line at a location downstream of said valve by a connecting line, and a first shut-off valve is disposed in said connecting line, where said measuring line comprises a second shut-off valve proximate said connection point.

* * * * *